US008894087B2

(12) United States Patent
Barthel et al.

(10) Patent No.: US 8,894,087 B2
(45) Date of Patent: Nov. 25, 2014

(54) FRONT UNIT FOR A SLIDING BOARD BINDING

(71) Applicant: Fritz Barthel, Bad Häring (AT)

(72) Inventors: Fritz Barthel, Bad Häring (AT); Johann Ortner, Münster (AT)

(73) Assignee: Fritz Barthel, Bad Häring (AU)

( * ) Notice: Subject to any disclaimer, the term of this patent is extended or adjusted under 35 U.S.C. 154(b) by 0 days.

(21) Appl. No.: 13/761,727

(22) Filed: Feb. 7, 2013

(65) Prior Publication Data

US 2013/0214513 A1 Aug. 22, 2013

(30) Foreign Application Priority Data

Feb. 7, 2012 (DE) ..... 10 2012 201 816

(51) Int. Cl.

| | |
|---|---|
| ***A63C 9/08*** | (2012.01) |
| ***A63C 9/00*** | (2012.01) |
| ***A63C 9/085*** | (2012.01) |
| ***A63C 9/086*** | (2012.01) |

(52) U.S. Cl.

CPC ..... *A63C 9/00* (2013.01); *A63C 9/0807* (2013.01); *A63C 9/08521* (2013.01); *A63C 9/08571* (2013.01); *A63C 9/086* (2013.01)

USPC ..... 280/614

(58) Field of Classification Search

CPC ..... A63C 9/0807; A63C 9/22; A63C 2201/06

USPC ..... 280/614, 617, 618, 619, 623, 624, 625, 280/628, 629

See application file for complete search history.

(56) References Cited

U.S. PATENT DOCUMENTS

| | | | | |
|---|---|---|---|---|
| 4,632,419 | A * | 12/1986 | Zoor | 280/614 |
| 5,249,820 | A * | 10/1993 | Burger et al. | 280/614 |
| 5,364,118 | A | 11/1994 | Burger et al. | |
| 7,735,851 | B2 * | 6/2010 | Shute et al. | 280/614 |
| 8,544,869 | B2 * | 10/2013 | Lehner | 280/611 |
| 2008/0116663 | A1 * | 5/2008 | Gyr | 280/611 |

FOREIGN PATENT DOCUMENTS

| | | | |
|---|---|---|---|
| DE | 27 14 853 | A1 | 10/1978 |
| DE | 40 07 667 | C1 | 6/1991 |
| DE | 42 34 348 | A1 | 4/1994 |
| DE | 196 01 545 | A1 | 7/1997 |
| EP | 0 167 765 | A1 | 1/1986 |
| EP | 0 199 098 | A2 | 10/1986 |
| EP | 2 392 388 | A1 | 12/2011 |
| FR | 2 567 409 | A1 | 1/1986 |

OTHER PUBLICATIONS

The search report for the corresponding European application 13154393.6-1658 dated Apr. 29, 2013, 5 pgs.

* cited by examiner

*Primary Examiner* — John Walters
(74) *Attorney, Agent, or Firm* — Rothwell, Figg, Ernst & Manbeck, P.C.

(57) ABSTRACT

The present invention provides a front unit (10) for a sliding board binding, comprising first engagement means of a first binding system (12) for fixing a front sole portion of a sliding board boot in a downhill position and second engagement means of a second binding system (14), the second engagement means having separate bearing means (34L, 34R) from the first engagement means, for pivotably mounting a sliding board boot about an axis (Q) extending transverse to the longitudinal axis (L) of the sliding board.

15 Claims, 7 Drawing Sheets

FRONT UNIT FOR A SLIDING BOARD BINDING

CROSS REFERENCE TO RELATED APPLICATION

Figure 1:
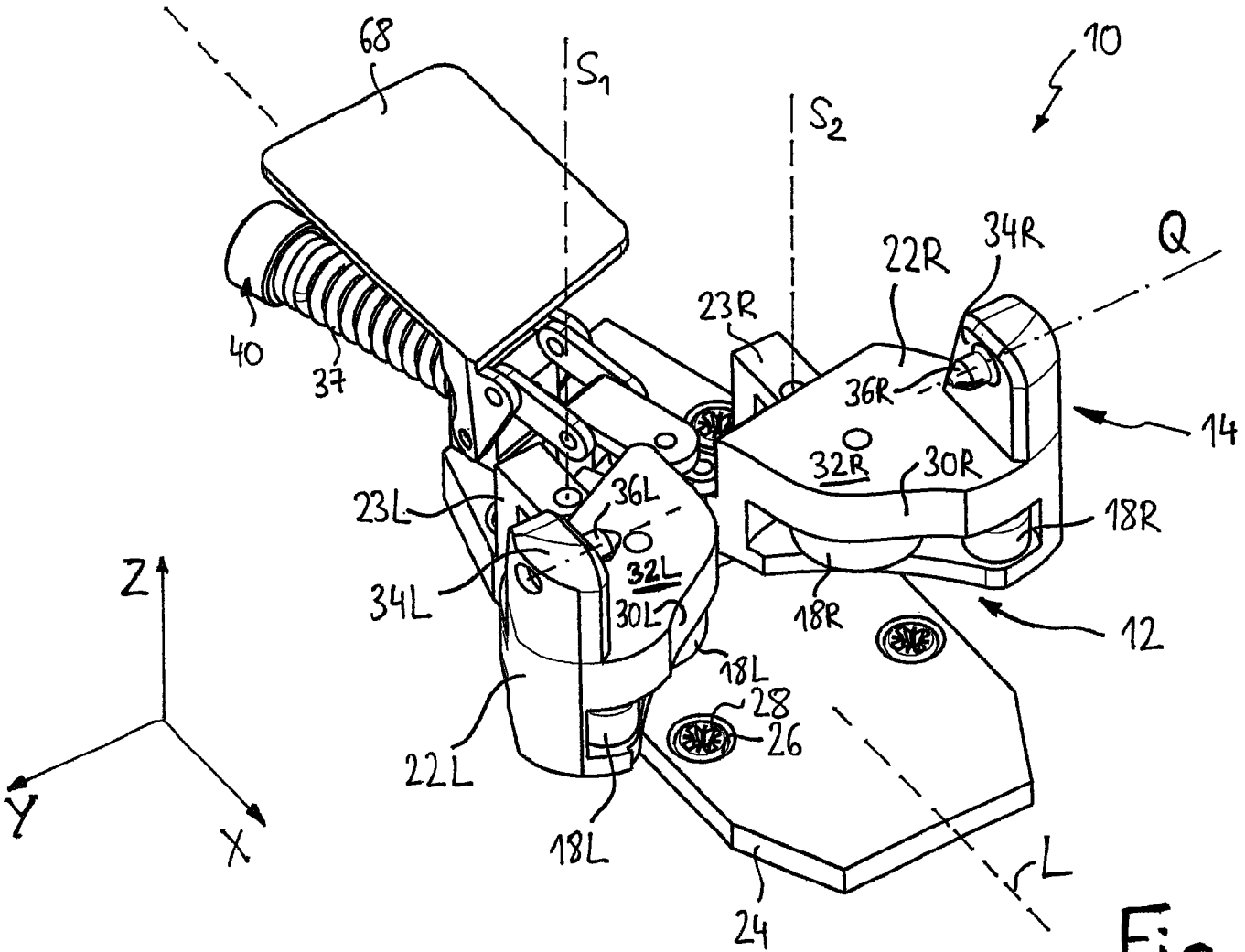

This application claims the benefit of German Patent Application No. 10 2012 201 816.6 filed on Feb. 7, 2012, the disclosure of which is incorporated herein in its entirety by reference.

The present invention relates to a front unit for a sliding board binding, comprising first engagement means of a first binding system for fixing a front sole portion of a sliding board boot in a downhill position.

A front unit comprising engagement means of this type is known in the prior art as a front part of a downhill binding, and generally comprises a sole-holding projection, which engages over a front, projecting portion of a sole of a ski boot, and further comprises lateral sole contact portions, which contact opposite front lateral portions of the sole of the ski boot, in such a way that the front sole portion of the ski boot is fixed to the front unit in a positive fit.

As well as the above-described downhill binding systems, front units are further known in the prior art comprising different binding systems, for example touring binding systems, which are characterised by engagement means which have rotary bearing means for rotatably mounting the ski boot on a front sole portion, in such a way that it is possible to travel uphill using a climbing skin which is fixed to the running surface of the ski. An expanded binding type of the touring binding system is known for example from EP 0 199 098 A2, and uses left and right bearing journals as bearing means, which face one another and are set up so as to engage lateral bearing openings of a touring ski boot, in such a way that the boot is mounted pivotably on the axis of rotation defined by the bearing journals, transverse to the longitudinal axis of the ski.

The downhill binding system is optimised for downhill travel, but does not make it possible to travel uphill, since the downhill binding system fixes the front sole portion of the boot, in such a way that it is not possible to lift the heel portion of the boot from the ski. So as to make it possible to descend with a binding of the touring binding system, a touring binding comprises an adjustable heel unit, which in a touring position releases the heel portion of the boot, in such a way that it can lift off from the sliding board and the boot can pivot about the transverse axis on the front unit, and which in a downhill position fixes the heel portion of the boot to the sliding board, in such a way that the boot is held immovably on the sliding board. However, when descending using the touring binding system, the front portion of the sliding board boot is thus only held by the bearing arrangement, in particular the two projecting bearing journals. Particular constructional measures are therefore necessary to provide these bearing means with the necessary stability and the required release means, so as not to have to accept excessively large drawbacks, by comparison with a front unit of a downhill binding system, in terms of stability, travel behaviour and release characteristics in the event of an emergency release.

The object of the present invention is therefore to provide a front unit for a sliding board binding which can be used in the manner of a tour binding for ascending a mountain, but has optimum travel behaviour and stability for downhill travel.

According to the invention, this object is achieved by a front unit for a sliding board binding comprising first engagement means of a first binding system for fixing a front sole portion of a sliding board boot in a downhill position and second engagement means of a second binding system, the second engagement means having separate bearing means from the first engagement means, for pivotably mounting a sliding board boot about an axis extending transverse to the longitudinal axis of the sliding board.

An important aspect of the invention thus involves the provision of two different engagement means of different binding systems in a single front unit, the first engagement means using a first binding system which is configured for immovably fixing the sliding board boot and thus for downhill travel, and the second engagement means using a second binding system which holds the sliding board boot pivotably on the front unit, in particular for travelling uphill. In this context, providing first engagement means and second engagement means means that the two engagement means are provided separately from one another, at least to the extent that a sliding board boot which is held in engagement by the first engagement means is not effectively held by the second engagement means, and conversely, a sliding board boot which is held in engagement by the second engagement means is not effectively held by the first engagement means.

As a result of providing two engagement means for two different binding systems on a single front unit, it is possible to provide a front unit comprising a binding system which is specialised for downhill travel and can make optimum travel properties, stability and safety possible during downhill travel, and simultaneously to use the front unit in a mode for uphill travel, in which the sliding board boot is pivotably mounted on the front unit.

The first engagement means preferably comprise a sole-holding projection which is set up so as to engage over a front, projecting portion of a sole of a sliding board boot, in such a way that a binder which is known per se for downhill bindings can be provided for the front, projecting portion of the sole of the sliding board boot, and the sliding board boot can thus be fixed highly stably in the downhill position.

The first engagement means of the front unit according to the invention can be held pivotably on a base part, which is rigidly fixed to a sliding board, of the front unit, and be biased into an engagement position by a tensioning means. In this way, when a force from the sliding board boot exceeding a predetermined release force acts on the front unit, the first engagement means can pivot counter to the force of the tensioning means so as to release the sliding board boot. In particular, a pivot movement of the engagement means about a vertical axis is conceivable, in such a way that the sliding board boot can be released laterally when a release torque acting about a vertical axis acts on the sliding board boot. The pivotable bearing of the engagement means may alternatively or additionally be used for opening and closing the front unit, so as to make it possible to enter and exit the front unit.

Preferably, the first engagement means further comprise lateral sole contact portions, which are set up so as to contact opposite front lateral portions of the sole of a sliding board boot, so as to fix the sliding board boot laterally. Laterally fixing the sliding board boot by way of the two lateral sole contact portions assists in fixing the boot to the front unit in the downhill position, so as to ensure that the boot is held particularly securely.

If the first engagement means comprise said lateral sole contact portions, each of the lateral sole contact portions is preferably formed on a respective associated engagement element, each of the engagement elements being held pivotably on a base part, which is rigidly fixed to a sliding board, of the front unit and the engagement elements being biased into an engagement position by a tensioning means. The lateral sole contact portions are thus pivotably mounted by way of separate engagement elements, in such a way that when the front unit is released, in particular in the event of a fall, when a force from the sliding board boot exceeding a predetermined release force acts in a lateral direction, the respective engagement element on the side loaded with force can be deflected so as to release the sliding board boot.

As a result, acceptable release behaviour in the event of a fall is ensured during downhill travel. Preferably, the two engagement elements are pivotable about a vertical axis, in such a way that the pivot axis can be mounted on the base part with a smaller construction height. A further reduction in the size of the front unit can be achieved if the two engagement elements are arranged on different axes, in particular on different sides of a central longitudinal axis of the sliding board.

Preferably, the lateral sole contact portions each comprise at least one contact roller for contacting the sole of the sliding board boot. Contact rollers of this type, which are known per se from the prior art, assist in a relative movement between the front sole of the sliding board boot and the lateral sole contact portion during the release of the sliding board boot in the event of an emergency release. The contact rollers make it possible to reduce undefined frictional relationships in the contact region between the boot and the front unit, in such a way that the release behaviour can be set more precisely and reliably.

In a further preferred embodiment, it is provided that the bearing means of the second engagement means comprise a left bearing portion and a right bearing portion, which are set up so as to engage an associated left counter bearing portion and an associated right counter bearing portion of a sliding board boot, so as to mount the sliding board boot pivotably about the axis extending transverse to the longitudinal axis of the sliding board, the bearing portions comprising a bearing journal or a bearing depression. Bearing means of this type are known per se from touring bindings. In particular, the use of bearing journals comprising conically tapering tips, which engage in corresponding, opposite lateral bearing depressions of a matching touring ski boot, are in widespread use. The front unit according to the invention can thus be used in a touring mode when the sliding board boot is held on the left and right bearing journals, and can be used in a downhill mode when the first engagement means immovably fix the front sole portion of the sliding board boot. In the downhill mode in particular, the bearing journals are thus not engaged in the bearing depressions of the touring ski boot.

If the two engagement means comprise the above-described left and right bearing portions, in a particularly preferred embodiment of the invention, the left bearing portion may be provided on a left projection and the right bearing portion may be provided on a right projection, the left and the right projection protruding, preferably upwards, proceeding from the first engagement means. A variant of this type has the advantage that the second engagement means can be provided directly on or above the first engagement means with a very simple construction, in such a way that the first engagement means may simultaneously act as supports for the second engagement means, in particular the upwardly protruding projections.

In a further embodiment of the invention, the second engagement means may be held pivotably and be biased into an engagement position by a tensioning means. This pivotable bearing can be used so as to move the second engagement means between an opening and a closing position, so as to couple and decouple the sliding board boot. Alternatively or additionally, the pivotable bearing of the second engagement means may provide a release mechanism, which can ensure emergency release, including in the touring mode, and thus offers increased safety even in the event of a fall when travelling uphill.

In a further preferred embodiment, it is conceivable for the left bearing portion to be provided on a left engagement element and for the right bearing portion to be provided on a right engagement element, the left engagement element and the right engagement element being pivotably held on a base part, which is rigidly fixed to a sliding board, of the front unit, and being biased into an engagement position by a tensioning means. By way of an arrangement of this type, the two opposite bearing portions of the second engagement means can be pivoted towards and away from one another, so as to move the respective counter bearing portions thereof of the sliding board boot towards and away from one another.

Features of the aforementioned embodiments can be integrated, in a particularly synergistic manner, into an embodiment which is characterised in that the first engagement means comprise a left and a right lateral sole contact portion, which are set up so as to contact opposite front left and right portions of a sole of a sliding board boot, so as to fix the sliding board boot laterally, the bearing means of the second engagement means comprising a left bearing portion and a right bearing portion, which are set up so as to engage an associated left counter bearing portion and an associated right counter bearing portion of a sliding board boot, so as to mount the sliding board boot pivotably about the axis extending transverse to the longitudinal axis of the sliding board, the bearing portions comprising a bearing journal or a bearing depression, the left lateral sole contact portion and the left bearing portion being provided on a shared left engagement means, which is held pivotably on a base part, which is rigidly fixed to the sliding board, of the front unit, the right lateral sole contact portion and the right bearing portion being provided on a shared right engagement means, which is held pivotably on the base part, and the engagement elements being biased into an engagement position by a tensioning means. In this embodiment, the first and second engagement means are divided into a left and a right engagement element. Thus, the left engagement element supports both the left lateral sole contact portion of the first engagement means and the left bearing portion of the second engagement means, only a single engagement element and accordingly only a single rotary bearing being required for both portions. The same synergy occurs for the right engagement element.

Further, in embodiments of the invention, it is preferred for the second engagement means to be arranged above the first engagement means. In this way, it is achieved that the first engagement means, which use a downhill binding system, can be arranged relatively close to the sliding board, in such a way that a relatively low position of the sliding board boot (tight against the sliding board), as desired for downhill travel, can be achieved.

If a front unit of the present invention comprises movable first and/or second engagement means, for example so as to implement a release mechanism or the possibility of adjustment between the opening position and the closing position of the front unit, in principle a mechanism known to a person skilled in the art from the field of conventional downhill bindings, touring bindings or the like can be adapted for moving these engagement means and in particular biasing this movement into an engagement position. However, it is particularly advantageous to provide that the first engagement means and/or the second engagement means comprise two pivotable engagement elements, which are biased into the engagement position by a tensioning means, the tensioning means comprising a displaceably held tensioning element, the conversion between the pivoting movements of the engagement elements and the displacement movement of the tensioning element being provided by way of a lever mechanism, which comprises: two levers which pivot in a manner corresponding to the engagement elements, a displacement portion which is displaced in a manner corresponding to the tensioning element, and an articulation element, which comprises a first and a second pivot point at which it is pivotably connected to the levers and comprises a third pivot point, positioned between the first and the second pivot point, at which it is pivotably connected to the displacement portion.

By way of a lever mechanism of this type, the conversion between the pivoting movements of the engagement elements and the displacement movement of the tensioning element is provided by a plurality of pivot bearings, without the need for a cam mechanism, a control cam mechanism or a linear guide, that is to say without the occurrence of frictional losses at elements which slide against one another. Rotary bearings can be produced with low wear and low friction at little expense. In particular, the disclosed lever mechanism implements the movement geometry of a Watt linkage, that is to say the specified arrangement of the pivot points on the articulation element always converts the pivot movement of the engagement elements into an approximately linear displacement movement of the displacement portion, without the displacement portion having to be forced onto a linear path by a linear guide or the like. Therefore, for example a spring element having a linear movement characteristic, for example a flat spiral spring, may be used for biasing the engagement elements, and at the same time frictional forces in the movement conversion can be reduced. The reduction in the frictional forces not only leads to a reduction in the wear and the maintenance expense, but also makes it possible to adjust the movement characteristics of the components, and thus the release behaviour of the front unit, more reliably and precisely.

In the lever mechanism of this last embodiment, the two levers are preferably formed by the engagement elements themselves, in such a way that the number of components can be kept to a minimum and the weight of the front unit can be reduced.

In a further preferred embodiment of the invention, the front unit comprises an actuation element which can be operated manually by the user for moving the first engagement means and/or the second engagement means between an engagement position, in which the engagement means hold a sliding board boot engaged, and an opening position, in which the engagement means release the sliding board boot. With an actuation element of this type, which is to be operated manually and can be operated by the user for example by hand or using a ski pole, it is thus possible for example to move the bearing means into an opening position before entering the second engagement means for the touring mode, that is to say in particular to move two opposite bearing portions sufficiently far away from one another that the sliding board boot can be positioned between the bearing portions. Moreover, an actuation element of this type can be set up so as to make it possible to exit the binding. The transition from the opening position into the engagement position may also be provided by manually operating the actuation element, for example by operation in the opposite direction by comparison with the operation for adjustment in the opening direction. Alternatively or additionally, the front unit may comprise an entry means, which upon entry into the binding brings about a partially or completely automatic adjustment of the front unit from the opening position into the engagement position as a result of a contact force exerted on the front unit by the sliding board boot. Overall, the technical effect of the aforementioned actuation element may be to move the elements of the front unit, which are relatively strongly biased, in particular the engagement elements and the elements of the lever mechanism, between the engagement position and the opening position by way of the actuation element, with a suitable force amplification or lever effect, in such a way that comfortable operation of the front unit is made possible.

In a front unit which is equipped with an above-described manually operable actuation unit, it may particularly advantageously be provided that the actuation element is pivotably coupled to a portion, which is rigidly fixed to a sliding board, of the front unit at a first actuation pivot axis, that the actuation element is pivotably coupled to an actuation member at a second actuation pivot axis, and that the actuation member is pivotably connected to an element of the lever mechanism, to one of the engagement elements or to the tensioning element at a third actuation pivot axis, the second actuation pivot axis passing a dead position, in which it intersects a connecting line between the first actuation pivot axis and the third actuation pivot axis, when the actuation element moves between the engagement position and the opening position. As a result of an arrangement of this type, the resilient force produced by the tensioning means can be used not only for biasing the engagement portions, but also for reliably locking the actuation element, specifically both in the opening position and in the engagement position. In both positions, the actuation element is held securely by the force of the tensioning means, the direction of the action of the force (towards the opening position or towards the engagement position) being reversed in the dead position.

In accordance with a further aspect, the present invention provides a sliding board binding comprising a front unit of the above-disclosed type according to the invention, that is to say a front unit according to any one of the appended claims, and a heel unit, which is set up so as to engage a heel portion of the sliding board boot. In this context, the heel unit is adjustable between a downhill position, in which it fixes a heel portion of the sliding board boot to the sliding board in a manner known per se, and a touring position, in which the heel unit releases the heel portion of the sliding board boot, in such a way that the sliding board boot can lift off from the sliding board and is held pivotably about the transverse axis of the touring binding system of the front unit, so as to make it possible to travel uphill. In the touring position, the heel unit may further provide a raising aid, on which the heel portion of the sliding board boot which pivots towards the sliding board can be braced, in such a way that the boot can be supported in a desired position relative to the sliding board. By way of a raising aid of this type, which may have one or more selectable heights above the sliding board, increased positioning of the touring binding system of the front unit above the downhill binding system of the front unit can be compensated and/or a hanging inclination can be compensated in a manner known per se, in such a way that the sliding board boot can be braced in an approximately horizontal position when travelling uphill.

Figure 2:
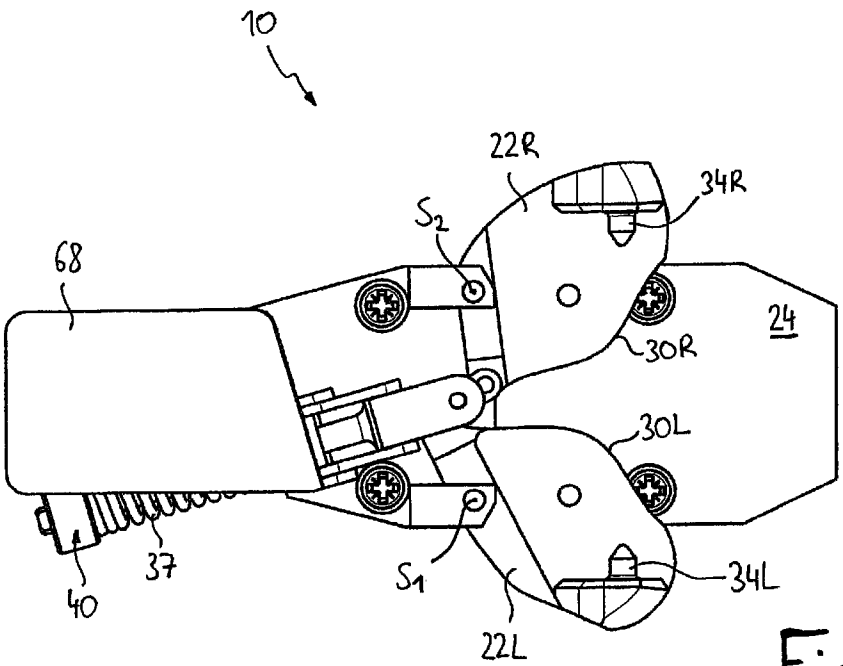
Figure 3:
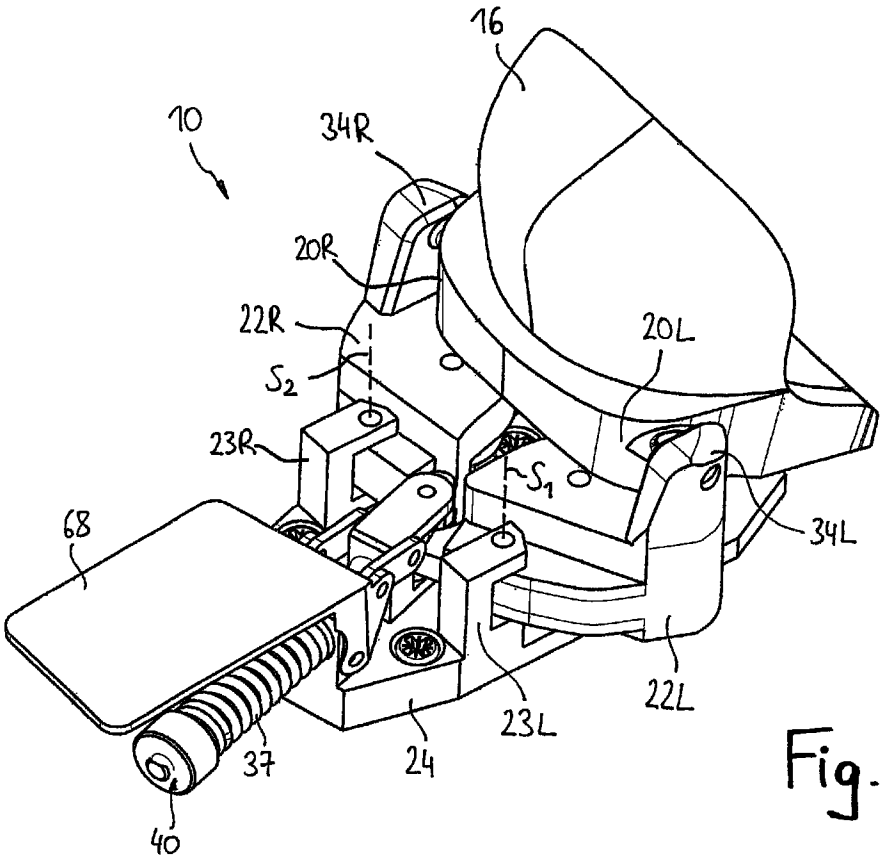
Figure 5:
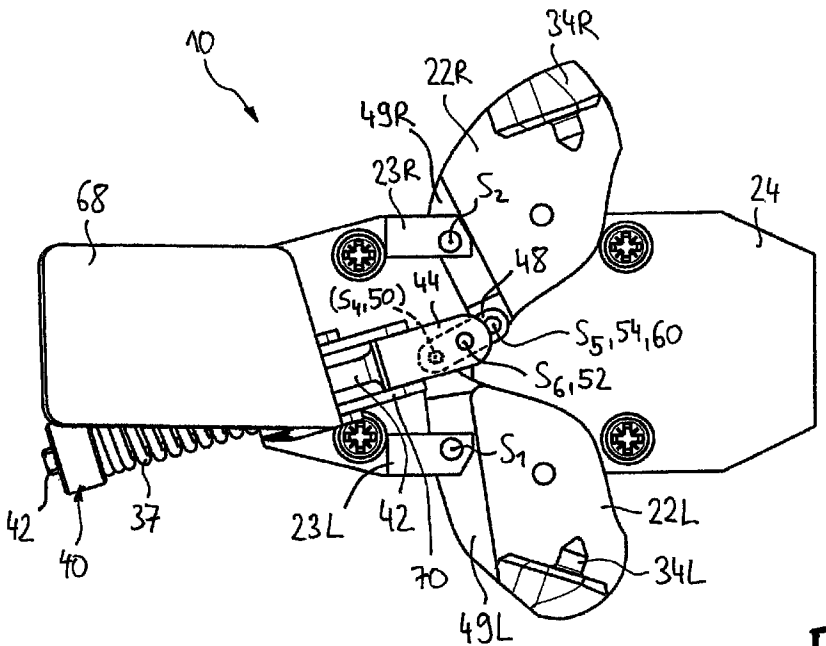
Figure 6:
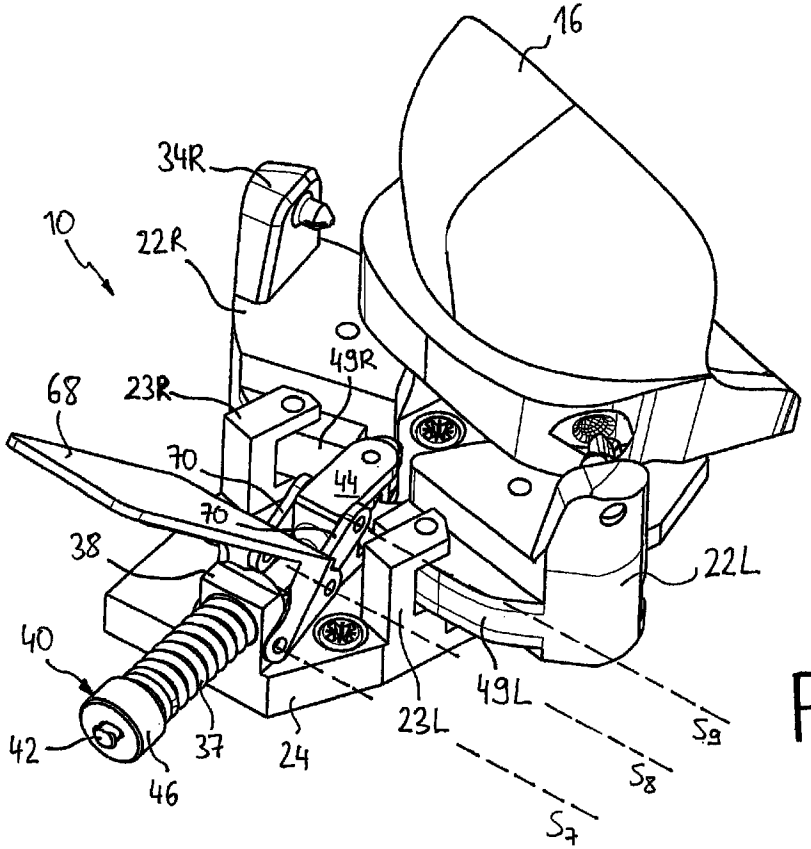
Figure 7:
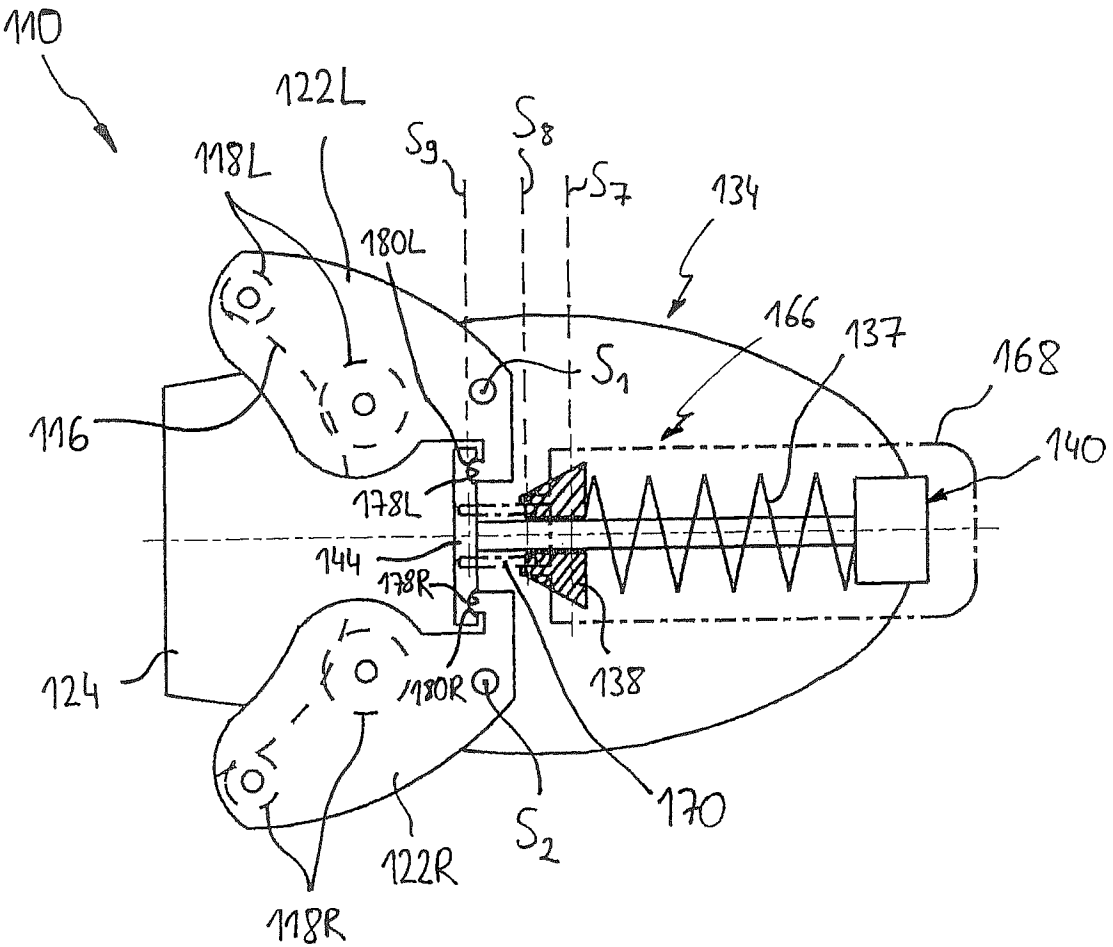

In the following, the invention is described in greater detail by way of preferred embodiments, with reference to the appended drawings, in which:

FIG. 1 is a perspective view of a front unit in accordance with a first embodiment of the present invention in an engagement position, FIG. 2 is a plan view of the front unit shown in FIG. 1, FIG. 3 is a perspective functional view of the front unit shown in FIG. 1, FIGS. 4 to 6 are a perspective view, a plan view and a perspective functional view respectively of the front unit of the first embodiment, but in an opening position, and FIG. 7 is a schematic sectional view of a front unit in accordance with a second embodiment of the invention in a section plane parallel to the plane of the sliding board.

At this point, it should be noted that in the context of the present disclosure, a sliding board is understood to mean any type of ski, snowboard or splitboard (snowboard which can be split in the longitudinal direction) or other board-like means for coupling to a boot and for moving along on snow and ice.

A front unit in accordance with the first embodiment of the invention, denoted generally as 10 in FIGS. 1 to 6, comprises downhill engagement means of a downhill binding system 12 for fixing a front sole portion 13 of a ski boot 16 in a downhill position and touring engagement means of a touring binding system 14 for pivotably mounting the ski boot 16 about a transverse axis Q extending transverse to a longitudinal axis L of the sliding board.

In a manner known per se, the downhill binding system 12 comprises left and right contact rollers 18L, 18R, in the embodiment two left contact rollers 18L and two right contact rollers 18R, which are set up for contact on a front left sole portion 20L and front right sole portion 20R respectively of the ski boot 16 and are preferably arranged rotatably about vertical axes of rotation.

The at least one left contact roller 18L is carried on a left engagement element 22L and the at least one right contact roller 18R is carried on a right engagement element 22R. The engagement elements 22L, 22R may be attached to a base part 24, which is to be fastened to the sliding board (not shown), of the front unit 10, in particular to bearing portions 23L, 23R, so as to be pivotable on the base part 24 about pivot axes $S_1$, $S_2$ extending in the Z direction. The base part 24 comprises fastening portions, in this case fastening holes 26 for fastening screws 28, in such a way that the base part 24 can be fastened on a sliding board. The fastening portions of the base part 24 thus define a plane of the sliding board and the longitudinal axis L of the sliding board. An X direction of the front unit 10 points along the longitudinal axis L of the sliding board, a Z direction points upwards, orthogonal to the plane of the sliding board, and a Y direction points orthogonal to the X direction and to the Z direction, that is to say in the lateral direction. In the context of the present disclosure, terms such as "up", "down", "front", "rear" and "lateral" or the like refer to this coordinate system, on the basis that the front unit 10 is mounted ready for use on a sliding board, a sliding board boot 16 of the user, as shown in FIG. 3, is coupled to the front unit 10, and said user is standing on a horizontal surface.

Each of the engagement elements 22L, 22R further comprises a sole-holding projection 30L, 30R, said projections being arranged above the contact rollers 18L, 18R respectively and projecting in a direction towards the ski boot 16, or in a rearward direction, with respect to the contact rollers 18L, 18R, in such a way that they can engage over and hold down the projecting front sole portion 13 of the ski boot 16 in a manner known per se. In the embodiment, the sole-holding projections 30L, 30R are formed by rear edges of a left plate portion 32L of the left engagement element 22L and a right plate portion 32R of the right engagement element 22R respectively, and a contact region for the sole portion 13 is located in particular on the underside of the plate portions 32L, 32R, which faces the sliding board.

A left bearing portion 34L is further arranged on the left engagement element 22L of the touring binding system 14, and a right bearing portion 34R of the touring binding system 14 is likewise arranged on the right engagement element 22R. In particular, the bearing portions 34L, 34R are each arranged on upwardly protruding projections of the engagement elements 22L and 22R respectively. In this context, the projections may be connected integrally to the engagement elements 22L, 22R, in such a way that the engagement elements 22L, 22R can each be produced substantially as a single-piece body. The projections are preferably arranged on rear and lateral outer edge regions of the engagement elements 22L, 22R, in such a way that they are at a sufficiently large distance from one another so as to receive the ski boot 16 between them.

In the embodiment, the bearing portions 34L, 34R each comprise a bearing journal 36L and 36R respectively, each bearing journal 36L, 36R preferably tapering conically towards the free end thereof. The bearing journals 36L, 36R point substantially towards one another, and define a shared bearing axis, on which the ski boot 16 can be pivotably mounted, along the transverse direction Q.

The front unit 10 further comprises a tensioning means, which produces a resilient force for biasing the engagement elements 22L, 22R in the engagement direction, that is to say towards the ski boot 16. In the following, an advantageous variant of a tensioning means of this type is described in greater detail, referring to FIGS. 4 to 6.

The tensioning means of the first embodiment comprises a spring means 37, preferably a flat spiral spring, which is braced on the one hand on a spring bearing 38, which is rigidly connected to the base body 24, and on the other hand on a tensioning element 40, which is held displaceably with respect to the base body 24. In this context, the tensioning element preferably comprises a rod portion 42 and a head portion 44 which is fastened to or formed on the end of the rod portion 42. The rod portion 42 is preferably passed through the spring bearing 38, through a clearance (not shown) in the spring bearing 38, in such a way that the tensioning element 40 can be displaced along the axis of the rod portion 42. At an end remote from the head portion 44, the rod portion 42 preferably carries a spring stop 46, against which the spring means 37 is braced. The spring stop 46 may particularly preferably be adjustable in the position thereof on the rod portion 42, for example comprising an internal thread which is engaged with an external thread of the rod portion 42, in such a way that a bias of the spring means 37 can be adjusted by rotating the spring stop 46. It can further be seen from the drawings that the rod portion 42 can penetrate the spring means 37 in the axial direction. If the rod portion 42 thus passes through both the spring means 37 and the spring bearing 38, the spring means 37 can be braced against the spring bearing 38, for example against an inner annular shoulder of a stepped hole in the spring bearing 38, or be held in an annular groove of the spring bearing 38.

The spring means 37 has a linear movement characteristic, that is to say the tensioning element 40 which is loaded by the spring means 37 moves back and forth in a substantially linear direction. The conversion between this displacement movement and the pivoting movement of the engagement elements 22L, 22R is provided by using a lever mechanism which operates by the principle of as a Watt linkage. The lever mechanism comprises an articulation element 48, on which the left engagement element 22L is pivotably mounted about a pivot axis $S_4$, the right engagement element 22R is pivotably mounted about a pivot axis $S_5$, and the tensioning element 40, in particular the head portion 44 of the tensioning element 40, is pivotably mounted about a pivot axis $S_6$. The pivot axes $S_4$, $S_5$ and $S_6$ are distinct from one another, extend mutually parallel and are preferably in substantially the same plane. In other words, a pivot bearing 50 (pivot point), at which the left engagement element 22L is mounted on the articulation element 48, a pivot bearing 52 (pivot point), at which the tensioning element 40 is mounted on the articulation element 48, and a pivot bearing 54 (pivot point), at which the right engagement element 22R is mounted on the articulation element 48, are arranged in a row on the articulation element 48, the pivot bearing 52 for the tensioning element 40 being arranged between the two other pivot bearings 50, 54, in particular in the centre directly between the pivot bearings 50, 54. Preferably, the three pivot axes $S_4$, $S_5$ and $S_6$ extend in the Z direction.

The articulation element 48 may comprise two plate portions 56, 58 which extend mutually parallel, for receiving the coupling projections 49L, 49R of the engagement elements 22L, 22R between them, in such a way that in particular bearing axes (only a bearing axis 60 of the right engagement element 22R is shown in the drawings) of the engagement elements 22L, 22R can be mounted or held stably on both sides in the plate portions 56, 58. Further, in the embodiment, the head portion 44 is formed in the manner of a fork and comprises two plate portions 62, 64, which extend mutually parallel and between which the articulation element 48 can be received and pivotably mounted at the pivot point 52. The fork-like head portion 44 thus engages around the articulation element 48, making stable mounting on the second pivot point 52 possible, in particular whilst preventing one-sided mounting.

The front unit 10 of the illustrated embodiment further comprises an actuation mechanism 66 for adjusting the front unit 10 between an opening position and an engagement position. The actuation mechanism 66 comprises a manually operable actuation element 68 in the form of a lever, which is pivotably mounted about a pivot axis $S_7$ on the base body 24 or on a part which is rigidly connected to the base body 24. In the embodiment, the actuation element 68 is articulated to the spring bearing 38 and the pivot axis $S_7$ preferably extends in the Y-direction. The actuation element 68 acts directly or indirectly on movable parts of the front unit 10, in such a way that the engagement elements 22L, 22R are moved towards or away from one another in a manner corresponding to the movement of the actuation element 68. In particular, the actuation element 68 is connected, so as to be pivotable about a pivot axis $S_8$, to an actuation member 70, which is in turn connected, so as to be pivotable about a pivot axis $S_9$, to the tensioning element 40, in this case in particular to the head portion 44. In this context, the pivot axis $S_8$ is positioned between the pivot axis $S_7$ and the pivot axis $S_9$, and, as a function of the position of the actuation element 68, can pass through a dead point (dead position), in which the pivot axis $S_8$ is positioned directly on a connecting line between the pivot axes $S_7$ and $S_9$, that is to say in particular all three pivot axes $S_7$, $S_8$ and $S_9$ are arranged in a shared plane. The dead point is a labile position, in such a way that outside this dead point the pivot axis $S_8$ is urged away from the dead point by the force of the spring means 37. The actuation element 68 can thus be moved into two different stable positions on either side of the dead point and locked there by virtue of the spring means 37.

In the following, a mode of functioning and operation of the front unit 10 in accordance with the embodiment of the invention will be described in greater detail.

Figure 4:
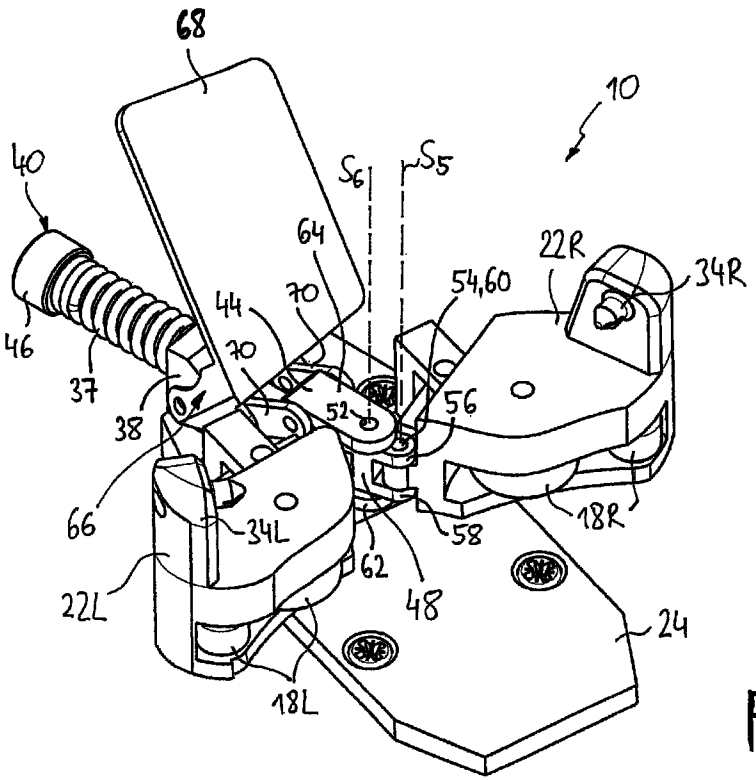

FIGS. 1 to 3 show an engagement position of the front unit 10, in which the engagement elements 22L, 22R are moved sufficiently far towards one another that a ski boot 16 can be held in the engagement of the downhill binding system 12 or of the touring binding system 14. By contrast, FIGS. 4 to 6 show an opening state of the front unit 10, in which the engagement elements 22L, 22R are pivoted sufficiently far away from one another that in particular a ski boot 16 which has previously been coupled to the touring binding system can now be released from the engagement with the two bearing portions 34L, 34R. The front unit 10 is also located in this position in particular before entry into the touring binding system 14.

The adjustment between the engagement position and the opening position, in particular for entering and exiting the touring binding system 14, can be provided by manually operating the actuation element 68 (manually opening and closing the front unit 10). For this purpose, in the embodiment the actuation element 68 can be lifted out of the position shown in FIGS. 1 to 3, resulting in the head portion 44 of the tensioning element 40 being urged towards the boot by way of the movement of the actuation member 70. During this movement, the spring means 37 is compressed, in such a way that the operation of the actuation element 68 counteracts the force of the spring means 37 until the dead point of the pivot axis $S_8$ is reached. The displacement of the tensioning element 40 displaces the articulation element 48 which is held thereon, and pivots the engagement elements 22L, 22R, which are coupled to the articulation element 48, in such a way that the bearing portions 34L, 34R move away from one another. After passing through the dead point, the tensioning element 40 moves a little in the opposite direction again, that is to say away from the boot 16, this movement corresponding to the force action direction of the spring means 37, in such a way that the actuation element 68 is also moved further by the force of the spring means 37, until it is stopped by a stop (opening position). In the embodiment, the stop is provided between the actuation element 68 and the actuation member 70, that is to say a pivot angle between the actuation element 68 and the actuation member 70 is defined on one side by contact between the two parts. In this context, the stop is selected in such a way that, in spite of the slight return movement of the tensioning element 40, the distance between the bearing portions 34L, 34R of the engagement elements 22L, 22R is still sufficiently large for releasing the boot 16 or for inserting the boot 16 between the bearing portions 34L, 34R.

For adjusting the front unit 10 from the opening position into the engagement position, the actuation element 68 can be moved in the opposite direction, in such a way that, in the embodiment, it is pivoted downwards towards the sliding board (away from the ski boot 16). After passing through the dead position, the spring means 37 acts to assist this pivot movement again, and urges the actuation element 68 further towards the engagement position, until it is stopped against a suitable stop, in this case for example on the tensioning element 40. As a result of the force of the spring means 37, the actuation element 68 is subsequently pressed securely against this stop, and the engagement position is thus locked.

During the aforementioned adjustment of the front unit 10, the force is basically only transferred at rotary bearing portions, that is to say in particular at the pivot axes $S_4$ to $S_9$. As a result of the particular movement geometry of the elements which are arranged in accordance with the model of a Watt linkage, the pivot movement of the engagement lever 32L, 32R is inevitably converted into a substantially linear displacement movement of the tensioning element 40, without a special linear guide or the like being necessary for this purpose. In particular, the tensioning element 40 does penetrate the spring bearing 38, but no guide or engagement is provided at this position. The rod portion 42 can penetrate the spring bearing 38, in particular with a large play, and move through it virtually without contact throughout the operation. The risk of a linearly movable element tilting in a guide and the occurrence of frictional losses can thus be prevented.

As a result of the above-disclosed arrangement in accordance with the embodiment of the invention, in the engagement position, the engagement elements 22L, 22R are biased towards one another by the force of the spring means 37, so as to hold the boot 16 reliably engaged, specifically either in the downhill binding system 12 or in the touring binding system 14. On the other hand, however, this means that when overcoming a predetermined release force, which is exerted by the boot 16, for example during a fall, on the engagement elements 22L, 22R, that is to say on the contact rollers 18L, 18R of the downhill binding system 12 or the bearing portions 34L, 34R of the touring binding system 14, the engagement elements 22L, 22R yield and can be urged away from one another counter to the force of the spring means 37. The boot 16 can subsequently be released from the front unit 10, so as to prevent injuries to the sportsman. The release force and the release characteristics can be influenced by setting the bias of the spring means 37, in particular by adjusting the spring stop 46.

FIG. 7 shows a second embodiment of the present invention. In the second embodiment, like or corresponding components are denoted by reference numerals which are increased by 100 by comparison with the first embodiment. In the following, only the differences from the first embodiment are discussed in greater detail, whilst for the rest reference is explicitly made to the description of the first embodiment.

FIG. 7 illustrates a sectional view parallel to the plane of the sliding board for a front unit 110 of the second embodiment, which comprises a left engagement element 122L and a right engagement element 122R, which are pivotably mounted on a base part 124 and comprise first engagement means of a downhill binding system, in the manner described explicitly in relation to the first embodiment, and second engagement means of a touring binding system, for holding a ski boot 116 in a downhill position and a touring position respectively. FIG. 7 schematically illustrates contact rollers 118L and 118R of the first engagement means.

The second embodiment differs from the first embodiment in the configuration of the tensioning means 134, by means of which the engagement elements 122L, 122R are biased into the engagement position. The tensioning means 134 comprises a spring element 137 having a linear movement characteristic, in particular a flat spiral spring, which is braced on the one hand on a spring bearing 138, which is rigidly fixed to the sliding board in terms of operation, and on the other hand to a tensioning element 140, which is guided displaceably along the longitudinal axis L of the sliding board. The tensioning element 140 can axially penetrate a central through-opening of the spring bearing 138, and further also be passed through the spring element 137. A head portion 144 of the tensioning element 140 may comprise a left contact portion 178L and a right contact portion 178R, with each of which a counter contact portion 180L, 180R of the left or right engagement elements 122L, 122R is in contact. During a pivot movement of the engagement elements 122L, 122R between the opening position and the engagement position, the contact portions 178L, 178R slide on the associated counter contact portions 180L, 180R, resulting in the pivoting movement of the engagement elements 122L, 122R and the displacement movement of the tensioning element 140 being converted directly into one another. In this context, a cam transfer takes place at the contact portions 178L, 178R and counter contact portions 180L, 180R, the mutually contacting portions sliding against one another.

In FIG. 7, the force of the spring element 137 acts in such a way that the tensioning element 140 is urged forwards, and thus the left engagement element 122L is biased anticlockwise and the right engagement element 122R is biased clockwise. Accordingly, the force of the spring element 137 causes the contact rollers 118L, 118R to be urged towards one another, and thus be pressed against the front sole portion of the ski boot 116. For a correspondingly high load of the ski boot 116, the engagement elements 122L, 122R thus yield in the lateral direction counter to the force of the spring element 137, so as to release the ski boot 116 in the event of a fall.

The front unit of the second embodiment may further comprise an actuation mechanism 166 for adjusting the front unit 110 between the opening position and the engagement position, which is built by the same constructional principle as the actuation mechanism 66 of the first embodiment. In particular, the actuation mechanism 166 may comprise a manually operable actuation element 168 in the form of a lever, which is mounted pivotably on the base body 124, or on a part which is rigidly connected to the base body 124, about a pivot axis $S_7$ extending in the Y direction. Preferably, the actuation element 168 is further connected, pivotably about a pivot axis $S_8$ extending in the Y direction, to at least one actuation member 170, which is in turn connected, pivotably about a pivot axis $S_9$ extending in the Y direction, to the tensioning element 140, in this case in particular to the head portion 144. In this context, the pivot axis $S_8$ is in turn positioned between the pivot axes $S_7$ and $S_9$, and, as a function of the position of the actuation element 168, can pass through a dead point (dead position), in which the pivot axis $S_8$ is positioned directly on a connecting line between the pivot axes $S_7$ and $S_9$, that is to say in particular all three pivot axes $S_7$, $S_8$ and $S_9$ are arranged in a shared plane. In this way, the actuation element 168 may, in the same manner as was described above for the first embodiment, be pivoted into two stable positions on either side of the dead point, and thus move the engagement elements 122L, 122R between the engagement position and the opening position by way of the tensioning element 140. The actuation mechanism 166 is in turn locked by the tensioning force of the spring element 137, which urges the actuation element 168 away from the dead point.

It should be added that in the above-disclosed embodiments, in particular the force-transmitting bearings of the front unit on the axes of rotation $S_1$, $S_2$, $S_4$ to $S_9$ may in principle be implemented using any types of rotary bearings known to a person skilled in the art. Preferably cylinder bearings are used, which only make rotation possible about one axis of rotation. Bearings of this type may be formed in a cost-effective and low-wear manner as pin bearings, in which a bearing pin, provided with a corresponding coating or lubrication on an outer cylinder surface thereof, is rotatably mounted in a matching bearing hole.

The invention claimed is:

1. Front unit for a sliding board binding, comprising:

first engagement means of a first binding system for fixing a front sole portion of a sliding board boot in a downhill position, and second engagement means of a second binding system, the second engagement means comprising bearing means which are separate from the first engagement means, for pivotably mounting the sliding board boot about an axis (Q) extending transverse to a longitudinal axis (L) of the sliding board.

2. Front unit according to claim 1, wherein the first engagement means comprise a sole-holding projection, which is set up so as to engage over a front, projecting portion of a sole of the sliding board boot.

3. Front unit according to claim 1, wherein the first engagement means are held pivotably on a base part, which is rigidly fixed to the sliding board, of the front unit, and are biased into an engagement position by a tensioning means.

4. Front unit according to claim 1, wherein the first engagement means comprise lateral sole contact portions, which are set up so as to contact opposite front, lateral portions of a sole of the sliding board boot so as to fix the sliding board boot laterally.

5. Front unit according to claim 4, wherein each of the lateral sole contact portions is respectively formed on an engagement element, which is held pivotably on a base part, which is rigidly fixed to the sliding board, of the front unit, the engagement elements being biased into an engagement position by a tensioning means.

6. Front unit according to claim 4, wherein the lateral sole contact portions each comprise at least one contact roller for contacting the sole of the sliding board boot.

7. Front unit according to claim 1, wherein the bearing means of the second engagement means comprise a left bearing portion and a right bearing portion, which are set up so as to engage an associated left counter bearing portion and an associated right counter bearing portion of a sliding board boot, so as to mount the sliding board boot pivotably about the axis (Q) extending transverse to the longitudinal axis of the sliding board, the bearing portions comprising a bearing journal or a bearing depression.

8. Front unit according to claim 7, wherein the left bearing portion is provided on a left projection and the right bearing portion is provided on a right projection, the left and the right projection protruding upwards proceeding from the first engagement means.

9. Front unit according to claim 1, wherein the second engagement means are held pivotably on a base part, which is rigidly fixed to the sliding board, of the front unit, and are biased into an engagement position by a tensioning means.

10. Front unit according to claim 7, wherein the left bearing portion is provided on a left engagement element and in that the right bearing portion is provided on a right engagement element, the left engagement element and the right engagement element being held pivotably on a base part, which is rigidly fixed to the sliding board, of the front unit, and being biased into an engagement position by a tensioning means.

11. Front unit according to claim 1, wherein:

the first engagement means comprise a left and a right lateral sole contact portion, which are set up so as to contact opposite front left and right portions of a sole of the sliding board boot, so as to fix the sliding board boot laterally, the bearing means of the second engagement means comprise a left bearing portion and a right bearing portion, which are set up so as to engage an associated left counter bearing portion and an associated right counter bearing portion of the sliding board boot, so as to mount the sliding board boot pivotably about the axis (Q) extending transverse to the longitudinal axis (L) of the sliding board, the bearing portions comprising a bearing journal or a bearing depression, the left lateral sole contact portion and the left bearing portion are provided on a shared left engagement means, which is held pivotably on a base part, which is rigidly fixed to the sliding board, of the front unit, the right lateral sole contact portion and the right bearing portion are provided on a shared right engagement means, which is held pivotably on the base part, and the engagement elements are biased into an engagement position by a tensioning means.

12. Front unit according to claim 1, wherein the second engagement means are arranged above the first engagement means.

13. Front unit according to claim 1, wherein at least one of the first engagement means and the second engagement means comprises two pivotable engagement elements which are biased into an engagement position by a tensioning means, the tensioning means comprising a displaceably held tensioning element, and wherein a conversion between pivoting movements of the engagement elements and displacement movement of the tensioning element is provided by way of a lever mechanism, which comprises:

two levers which pivot in a manner corresponding to the engagement elements, a displacement portion which is displaced in a manner corresponding to the tensioning element, and an articulation element which comprises a first and a second pivot point at which it is pivotably connected to the levers and comprises a third pivot point, positioned between the first and the second pivot point at which it is pivotably connected to the displacement portion.

14. Front unit according to claim 13, wherein the two levers of the lever mechanism are formed by the engagement elements.

15. Front unit according to claim 1, further comprising an actuation element which can be operated manually by the user for moving at least one of the first engagement means and the second engagement means between an engagement position, in which the engagement means hold the sliding board boot engaged, and an opening position, in which the engagement means release the sliding board boot.

* * * * *